US008810219B2

(12) United States Patent
Suzuki

(10) Patent No.: US 8,810,219 B2
(45) Date of Patent: Aug. 19, 2014

(54) VOLTAGE REGULATOR WITH TRANSIENT RESPONSE

(75) Inventor: Teruo Suzuki, Chiba (JP)

(73) Assignee: Seiko Instruments Inc., Chiba (JP)

( * ) Notice: Subject to any disclaimer, the term of this patent is extended or adjusted under 35 U.S.C. 154(b) by 225 days.

(21) Appl. No.: 13/606,722

(22) Filed: Sep. 7, 2012

(65) Prior Publication Data

US 2013/0069607 A1 Mar. 21, 2013

(30) Foreign Application Priority Data

Sep. 15, 2011 (JP) ..... 2011-201444
Jul. 12, 2012 (JP) ..... 2012-156619

(51) Int. Cl.
*G05F 1/10* (2006.01)
*G05F 1/656* (2006.01)
*G05F 1/575* (2006.01)

(52) U.S. Cl.
CPC ..... *G05F 1/575* (2013.01)
USPC ..... 323/274; 323/275; 323/276; 323/284

(58) Field of Classification Search
CPC ..... G05F 1/575; G05F 1/561; G05F 1/565; G05F 1/468; G05F 3/22
USPC ..... 323/274, 275, 276, 284
See application file for complete search history.

(56) References Cited

U.S. PATENT DOCUMENTS

| | | | | |
|---|---|---|---|---|
| 4,808,907 | A * | 2/1989 | Main | 323/316 |
| 5,686,820 | A * | 11/1997 | Riggio, Jr. | 323/273 |
| 5,852,359 | A * | 12/1998 | Callahan et al. | 323/274 |
| 6,218,819 | B1 * | 4/2001 | Tiwari | 323/285 |
| 6,377,033 | B2 * | 4/2002 | Hsu | 323/274 |
| 6,441,594 | B1 * | 8/2002 | Connell et al. | 323/274 |
| 6,674,273 | B2 * | 1/2004 | Oglesbee | 323/284 |
| 7,068,018 | B2 * | 6/2006 | Kanakubo | 323/274 |
| 7,199,566 | B2 * | 4/2007 | Suzuki | 323/274 |
| 7,646,188 | B2 * | 1/2010 | Suzuki | 323/284 |
| 2005/0162141 | A1 | 7/2005 | Kanakubo | |

* cited by examiner

*Primary Examiner* — Bao Q Vu
(74) *Attorney, Agent, or Firm* — Brinks Gilson & Lione

(57) ABSTRACT

A voltage regulator having good transient response characteristics and maintaining stable operation is provided. The voltage regulator includes: a first MOS transistor having a gate terminal connected to an output terminal of the differential amplifier circuit; a first constant current source provided between the first MOS transistor and a ground terminal; an output MOS transistor having a gate terminal connected to a drain terminal of the first MOS transistor via a phase compensation circuit; a second MOS transistor having a gate terminal to which an output of the differential amplifier circuit is input and a drain terminal connected to the gate terminal of the output MOS transistor; and a second constant current source provided between the second MOS transistor and a ground terminal.

6 Claims, 6 Drawing Sheets

VOLTAGE REGULATOR WITH TRANSIENT RESPONSE

RELATED APPLICATIONS

This application claims priority under 35 U.S.C. §119 to Japanese Patent Application Nos. 2011-201444 filed on Sep. 15, 2011 and 2012-156619 filed on Jul. 12, 2012, the entire content of which is hereby incorporated by reference.

BACKGROUND OF THE INVENTION

1. Field of the Invention

The present invention relates to a voltage regulator which generates a constant output voltage Vout upon receiving an input voltage, and more specifically to transient response characteristics and stable operation of a voltage regulator.

2. Description of the Related Art

In general, a voltage regulator generates a constant output voltage Vout to an output terminal 16 upon receiving an input voltage Vin which is input to an input terminal 15. The voltage regulator supplies electric current in response to load fluctuations to maintain the output voltage Vout constant consistently.

FIG. 2 is a circuit diagram of a conventional voltage regulator.

A reference voltage circuit 110 generates a reference voltage Vref. Bleeder resistors 111 and 112 divide the output voltage Vout of the output terminal 16 to generate a feedback voltage Vfb. The reference voltage Vref and the feedback voltage Vfb are input to an input terminal of a differential amplifier 120. An output voltage of the differential amplifier 120 is input to a gate terminal of a MOS transistor 123 which constitutes a first source ground amplifier circuit. The MOS transistor 123 has a source terminal connected to the input terminal 15 and a drain terminal connected to a constant current source 124, a resistor 121, and a capacitor 122. An output of the MOS transistor 123 is input to a gate terminal of a MOS transistor 114, which constitutes a second source ground amplifier circuit, via the resistor 121. The MOS transistor 114 has a source terminal connected to the input terminal 15 and a drain terminal connected to the bleeder resistor 111. The output terminal 16 of the voltage regulator is a contact between the MOS transistor 114 and the bleeder resistor 111. The output terminal 16 of the voltage regulator is connected to a load capacitor CL and to a load having a load resistor RL.

The operation of the conventional voltage regulator will be described below.

If the reference voltage Vref is greater than the feedback voltage Vfb, the output of the differential amplifier 120 is high, which increases the ON resistance of the MOS transistor 123. If the ON resistance of the MOS transistor 123 increases, the voltage at the gate terminal of the MOS transistor 114 decreases via the resistor 121. Since the ON resistance of the MOS transistor 114 decreases, the output voltage Vout increases. Therefore, the voltage regulator operates such that the feedback voltage Vfb equals the reference voltage Vref. If the feedback voltage Vfb is greater than the reference voltage Vref, the operation is performed in a manner opposite to the above and thus the output voltage Vout decreases.

The voltage regulator always maintains the feedback voltage Vfb and the reference voltage Vref equal to each other, thereby generating a constant output voltage Vout.

The voltage regulator requires a wide frequency band in order to improve transient response characteristics. The conventional voltage regulator employs a voltage three-stage amplifier circuit configuration to improve transient response characteristics by using a wide frequency band even in the case of relatively less consumption current. The voltage three-stage amplifier circuit configuration, however, causes a phase delay of 180 degrees or more, by which the voltage regulator is susceptible to unstable operation such as oscillation. Therefore, the conventional voltage regulator additionally has the resistor 121 and the capacitor 122. The phase delay, which occurs in the voltage three-stage amplifier circuit, is compensated by generating a zero point by the resistor 121 and a parasitic capacitance of the MOS transistor 114 to maintain stable operation (for example, refer to Patent Document 1).

[Patent Document 1] Japanese Patent Application Laid-Open No. 2005-215897

SUMMARY OF THE INVENTION

The conventional voltage regulator additionally includes the resistor 121 and the capacitor 122 to perform phase compensation, thereby maintaining stable operation. Meanwhile, it is necessary to charge and discharge electric charges of the parasitic capacitance of the MOS transistor 114 in order to control the gate voltage of the MOS transistor 114.

Therefore, in the conventional voltage regulator, a delay occurs in charging and discharging the electric charges of the parasitic capacitance of the MOS transistor 114 due to an effect of the resistor 121 at the time of the charging and discharging. The delay in charging and discharging the parasitic capacitance of the MOS transistor 114 causes a problem of increasing the undershoot or overshoot of the output voltage Vout in a load transient response.

The present invention has been provided in view of the above problem. Therefore, it is an object of the present invention to provide a voltage regulator having good transient response characteristics and capable of maintaining stable operation.

In order to solve the above problem, to a voltage three-stage amplifier circuit including a differential amplifier circuit, a first source ground amplifier circuit having a phase compensation circuit, and a second source ground amplifier circuit, which is an output circuit, the present invention adds a third source ground amplifier circuit between the differential amplifier circuit and the second source ground amplifier circuit.

More specifically, the present invention provides a voltage regulator including: a differential amplifier circuit which receives an input of a reference voltage output from a reference voltage circuit and an input of a feedback voltage obtained by dividing an output voltage of the voltage regulator and then amplifies and outputs a difference between the reference voltage and the feedback voltage, a first MOS transistor having a gate terminal connected to an output terminal of the differential amplifier circuit, a first constant current source which is provided between the first MOS transistor and a ground terminal, an output MOS transistor having a gate terminal connected to a drain terminal of the first MOS transistor via a phase compensation circuit, a second MOS transistor having a gate terminal to which an output of the differential amplifier circuit is input and a drain terminal connected to the gate terminal of the output MOS transistor, and a second constant current source provided between the second MOS transistor and a ground terminal.

The output of the MOS transistor which constitutes the third source ground amplifier circuit is connected to the gate of the output MOS transistor without passing through a resistor. This enables the gate of the output MOS transistor to be controlled without delay. Therefore, even though a voltage three-stage amplifier circuit having a phase compensation circuit is used, the gate of the output MOS transistor is controllable without passing through the resistor of the phase compensation circuit, which enables an improvement of transient response characteristics.

DETAILED DESCRIPTION OF THE PREFERRED EMBODIMENTS

A voltage regulator of the present invention will now be described in detail hereinafter with reference to the accompanying drawings.

First Embodiment

Figure 1:
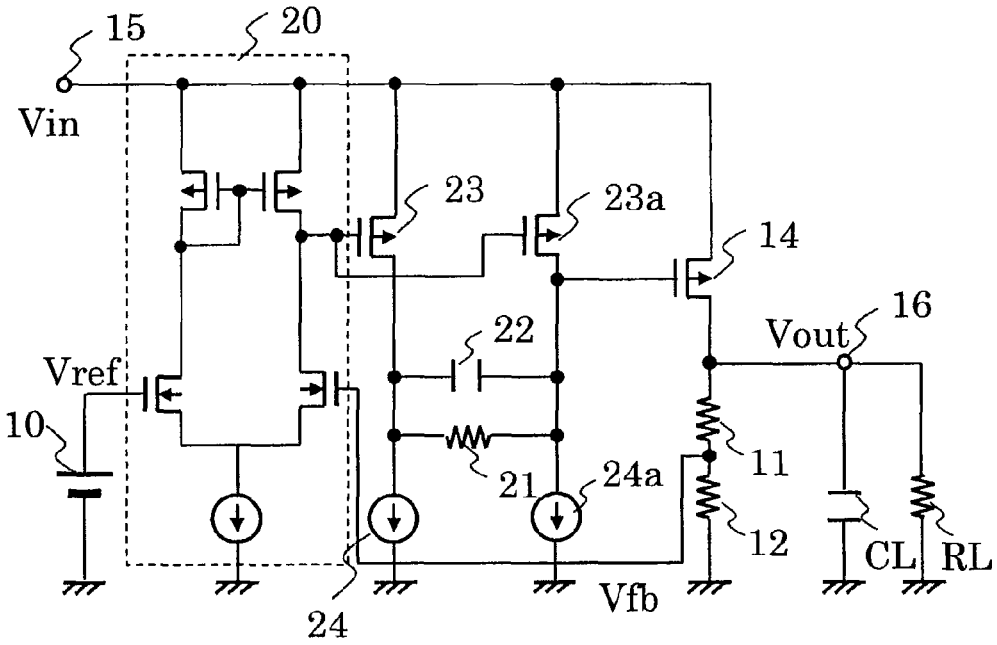
FIG. 1 is a circuit diagram of a voltage regulator according to a first embodiment.
Figure 2:
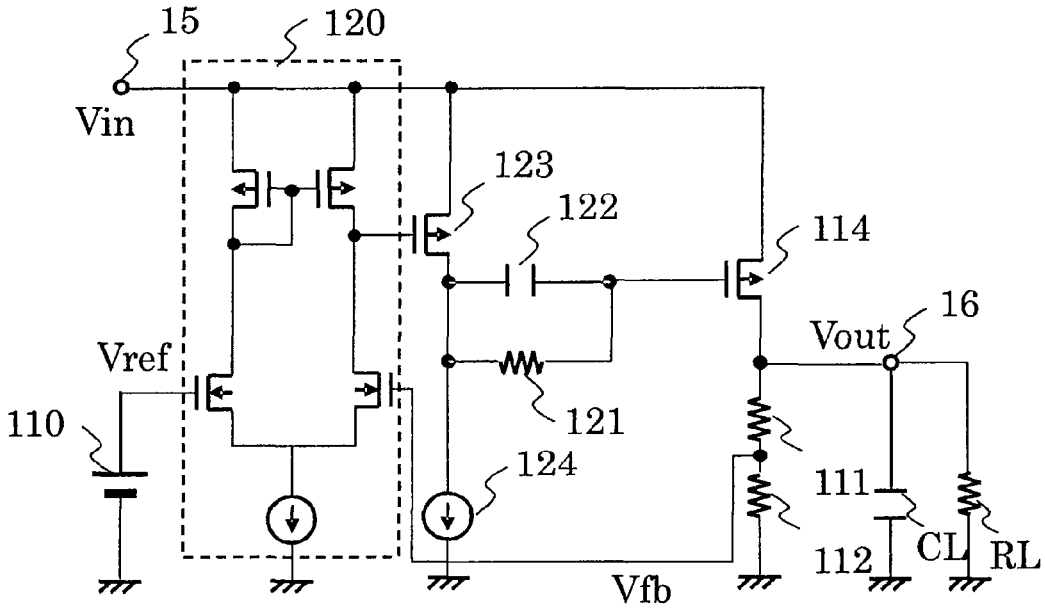
FIG. 2 PRIOR ART
FIG. 2 is a circuit diagram of a conventional voltage regulator.

Referring to FIG. 1, there is provided a circuit diagram of a voltage regulator according to a first embodiment.

The voltage regulator according to the first embodiment includes a reference voltage circuit 10, a differential amplifier 20, MOS transistors 23 and 23*a*, constant current sources 24 and 24*a*, a resistor 21, a capacitor 22, a MOS transistor 14, which is an output MOS transistor, and bleeder resistors 11 and 12.

The bleeder resistors 11 and 12 generate a feedback voltage Vfb by dividing an output voltage Vout of an output terminal 16. The differential amplifier 20 compares a reference voltage output from the reference voltage circuit 10 with the feedback voltage Vfb. An output of the differential amplifier 20 is input to a gate terminal of the MOS transistor 23 constituting a first source ground amplifier circuit and to a gate terminal of the MOS transistor 23*a* constituting a third source ground amplifier circuit. The MOS transistor 23 has a source terminal, which is connected to the input terminal 15, and a drain terminal, which is connected to the constant current source 24, the resistor 21, and the capacitor 22. The MOS transistor 23*a* has a source terminal, which is connected to the input terminal 15, and a drain terminal, which is connected to the constant current source 24*a*, the resistor 21, and the capacitor 22. Moreover, the drain of the MOS transistor 23*a* is connected to the gate terminal of the MOS transistor 14 constituting a second source ground amplifier circuit. The MOS transistor 14 has a source terminal connected to the input terminal 15 and a drain terminal connected to the bleeder resistor 11. An output terminal 16 of the voltage regulator is a contact between the MOS transistor 14 and the bleeder resistor 11. The output terminal 16 of the voltage regulator is connected to a load capacitor CL and to a load having a load resistor RL.

Here, elements related to the first source ground amplifier circuit and the third source ground amplifier circuit are set so as to obtain an equal voltage across the resistor 21. For example, the MOS transistor 23 and the MOS transistor 23*a* are set so as to obtain an equal aspect ratio (W/L). Furthermore, the constant current source 24 and the constant current source 24*a* are set so as to obtain an equal current value. Furthermore, for example, in the case of a change in the aspect ratio of the MOS transistor 23 and the MOS transistor 23*a*, the current ratio of the constant current source 24 and the constant current source 24*a* is also set so as to adapt to the aspect ratio.

The following describes the operation of the voltage regulator according to the first embodiment.

The voltage at the contact between the MOS transistor 14 and the bleeder resistor 11 reaches the output voltage Vout, which thereby generates a feedback voltage Vfb at the bleeder resistor 11 and the bleeder resistor 12.

The differential amplifier 20 has an input terminal to which the reference voltage Vref and the feedback voltage Vfb are input and outputs an output voltage of the output terminal to the gate terminal of the MOS transistor 23 and to the gate terminal of the MOS transistor 23*a*.

The MOS transistor 23 and the constant current source 24 of the first source ground amplifier circuit control the gate terminal of the MOS transistor 14 via the resistor 21 and the capacitor 22, which constitute a phase compensation circuit. The MOS transistor 23*a* and the constant current source 24*a* of the third source ground amplifier circuit control the gate terminal of the MOS transistor 14. The output of the third source ground amplifier circuit does not pass through the resistor 21 of the phase compensation circuit, thereby enabling the voltage at the gate terminal of the MOS transistor 14 to be set to a desired voltage without delay.

Here, the voltage regulator is designed so that the MOS transistor 23 and the MOS transistor 23*a* have the same aspect ratio and the constant current source 24 and the constant current source 24*a* have the same current value. This provides an equal output voltage for the first source ground amplifier circuit and the third source ground amplifier circuit. Alternatively, the voltage regulator is designed so that, even in the case of a change in the aspect ratio of the MOS transistor 23 and the MOS transistor 23*a*, the current ratio of the constant current source 24 and the constant current source 24*a* adapts to the aspect ratio. This provides an equal output voltage for the first source ground amplifier circuit and the third source ground amplifier circuit.

Subsequently, phase compensation of the voltage regulator according to the first embodiment will be described.

The MOS transistor 14, which is an output transistor, has much larger size than other transistors. Therefore, the parasitic capacitance between the gate and the drain of the MOS transistor 14 has a larger value than other transistors due to a mirror effect.

Here, for the parasitic capacitance between the gate and the drain of the MOS transistor 14, the capacitance of the capacitor 22 is set to a negligibly-small value. This causes a pole FPL2 at the lowest frequency in this system and a pole FPH2 at a higher frequency than the lowest frequency due to a combined resistance of the output resistances of the MOS transistor 23 and the MOS transistor 23*a* and due to the parasitic capacitance between the gate and the drain of the MOS transistor 14.

Moreover, a pole FPL3 occurs at the lowest frequency in this system and a pole FPH4 occurs at a higher frequency than the lowest frequency due to a combined resistance of the output resistance of the MOS transistor 14 and the load resistance RL and due to the capacitance CL. Further, a zero point FZ1 occurs at a frequency which depends on the parasitic capacitance between the gate and the drain of the MOS transistor 14 and the resistance 21.

The voltage regulator according to the first embodiment having the above configuration performs phase compensation as described below. Note that, however, a phase delay in the differential amplifier 20 is not considered as a phase delay to be compensated for in this system.

First, a phase delay of 90 degrees occurs at the pole FPL2 caused by the MOS transistor 23, which constitutes the first source ground amplifier circuit. This phase delay is advanced by 90 degrees at the zero point FZ1 so that the phase becomes normal again. Here, the resistance value of the resistor 21 is regulated to cause the zero point FZ1 at a lower frequency than the frequency of the pole FPH2 or the pole FPL3 which subsequently occurs. Thereby, the voltage regulator is able to secure a phase margin, thus enabling stable operation to be maintained.

As described hereinabove, according to the voltage regulator of the first embodiment, the present invention is able to provide a voltage regulator having good transient response characteristics at the time of a load transient response and capable of maintaining stable operation.

Second Embodiment

Figure 3:
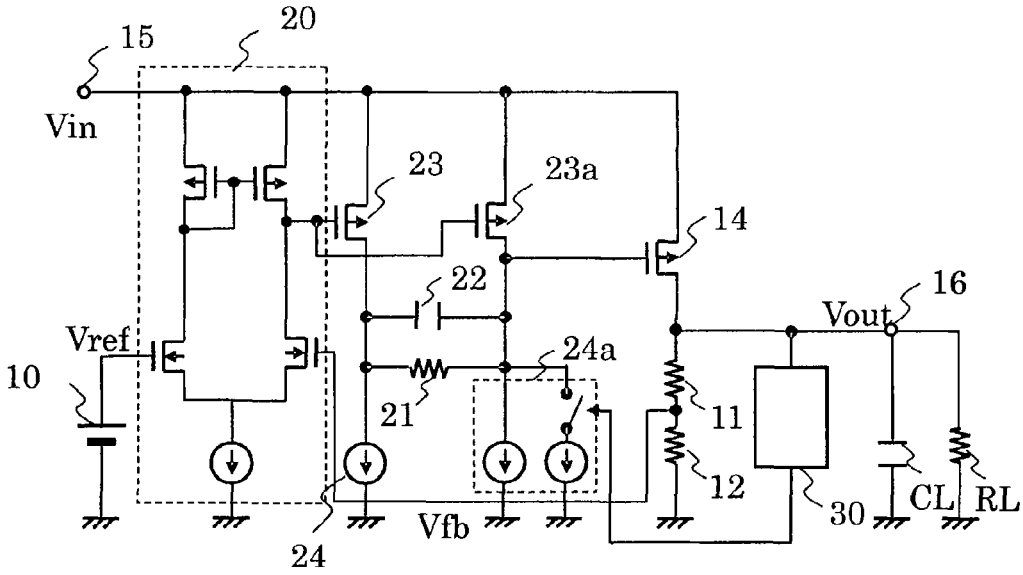
FIG. 3 is a circuit diagram of a voltage regulator according to a second embodiment.

FIG. 3 is a circuit diagram of a voltage regulator according to a second embodiment. The voltage regulator according to the second embodiment has an output load current detection circuit 30 which senses an output load current. Moreover, the constant current source 24*a* additionally has a switch circuit and a constant current source which are sequentially connected. The circuit configuration is the same as in the first embodiment except the output load current detection circuit 30 and the constant current source 24*a*.

The output load current detection circuit 30 has a terminal for outputting a detection signal connected to a switch circuit of the constant current source 24*a*. Further, the output load current detection circuit 30 switches the current value of the constant current source 24*a* according to the detection signal.

For example, in the case of an increase in an output load current, the output load current detection circuit 30 increases the current value of the constant current source 24*a*. This causes the MOS transistor 14 to discharge electric charges of the parasitic capacitance of the gate terminal quickly. Therefore, the voltage at the gate terminal of the MOS transistor 14 can be set to a desired voltage quickly, thus further improving the transient response characteristics.

Although the current value of the constant current source 24*a* is increased in this embodiment, the current value of the constant current source 24 may be increased.

Third Embodiment

Figure 4:
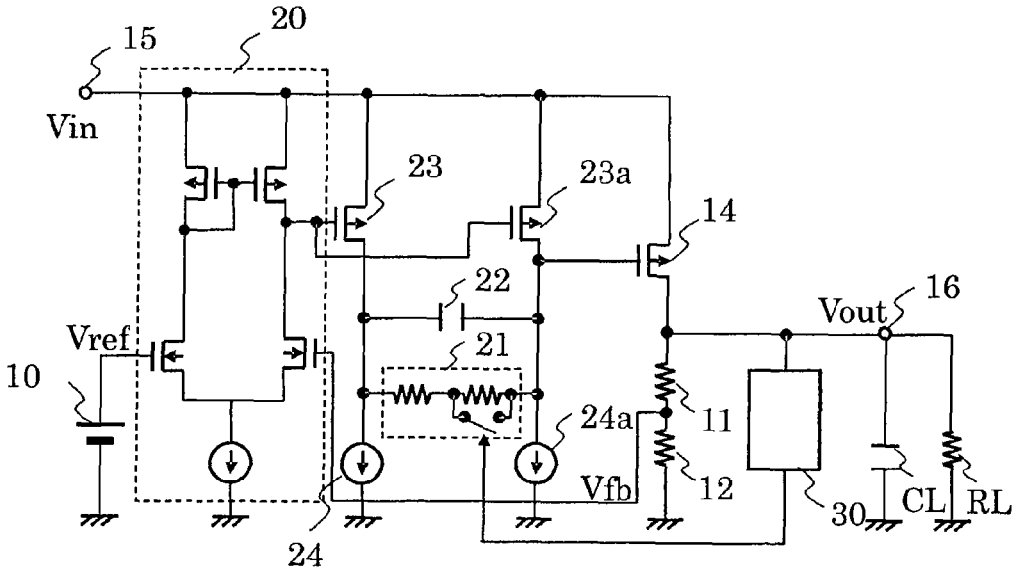
FIG. 4 is a circuit diagram of a voltage regulator according to a third embodiment.

FIG. 4 is a circuit diagram of a voltage regulator according to a third embodiment.

The voltage regulator according to the third embodiment has an output load current detection circuit 30 which senses output load current. Moreover, the resistor 21 additionally has a switch circuit and a constant current source which are connected in parallel. The circuit configuration is the same as in the first embodiment except the output load current detection circuit 30 and the resistor 21.

The output load current detection circuit 30 has a terminal for outputting a detection signal connected to the switch circuit of the resistor 21. In addition, the output load current detection circuit 30 switches the resistance value of the resistor 21 according to the detection signal.

For example, in the case of an increase in an output load current, the output load current detection circuit 30 decreases the resistance value of the resistor 21. This enables the resistance value to be switched and thus the frequency at the zero point to be arbitrarily changed for the frequency pole which depends on the output load current. Therefore, the stability of the operation is further improved.

Fourth Embodiment

Figure 5:
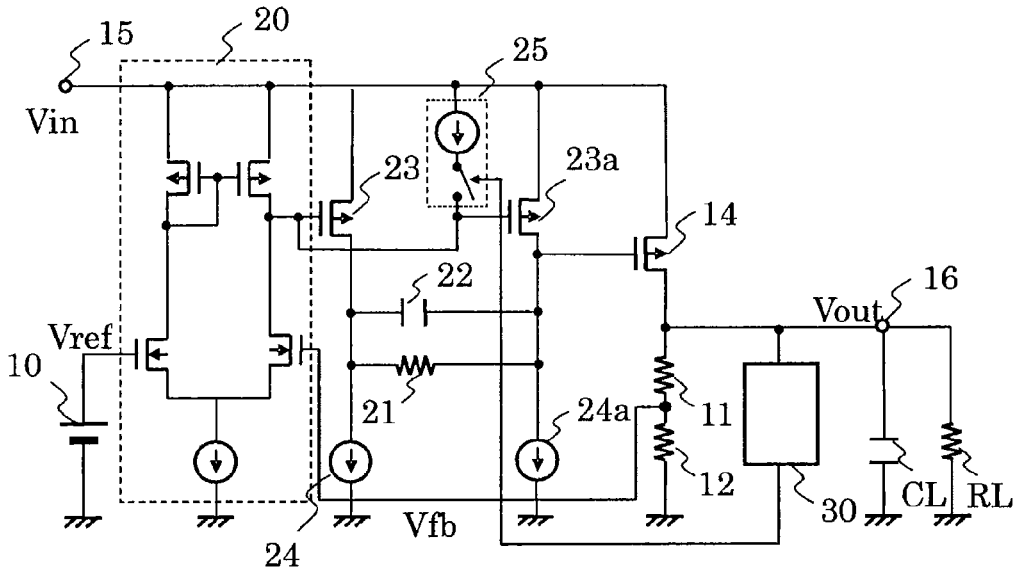
FIG. 5 is a circuit diagram of a voltage regulator according to a fourth embodiment.

FIG. 5 is a circuit diagram of a voltage regulator according to a fourth embodiment.

The voltage regulator according to the fourth embodiment further includes an output load current detection circuit 30 and a constant current source 25 having a switch circuit sequentially connected thereto, in addition to the voltage regulator of the first embodiment. The circuit configuration is the same as in the first embodiment except the output load current detection circuit 30 and the constant current source 25.

The output load current detection circuit 30 has a terminal for outputting a detection signal connected to the switch circuit. Further, the output load current detection circuit 30 switches the constant current source 25 according to the detection signal.

For example, in the case of an increase in an output load current, the output load current detection circuit 30 turns on the switch circuit of the constant current source 25 to supply electric current to the gate terminal of the MOS transistor 23 and the gate terminal of the MOS transistor 23*a* from the constant current source 25. Accordingly, the drain current of the MOS transistor 23 and the drain current of the MOS transistor 23*a* decrease, and therefore the constant current source 24 and the constant current source 24*a* enable the voltage at the gate terminal of the MOS transistor 14 to be set to a desired voltage quickly. In other words, the transient response characteristics of the voltage regulator are improved.

Fifth Embodiment

Figure 6:
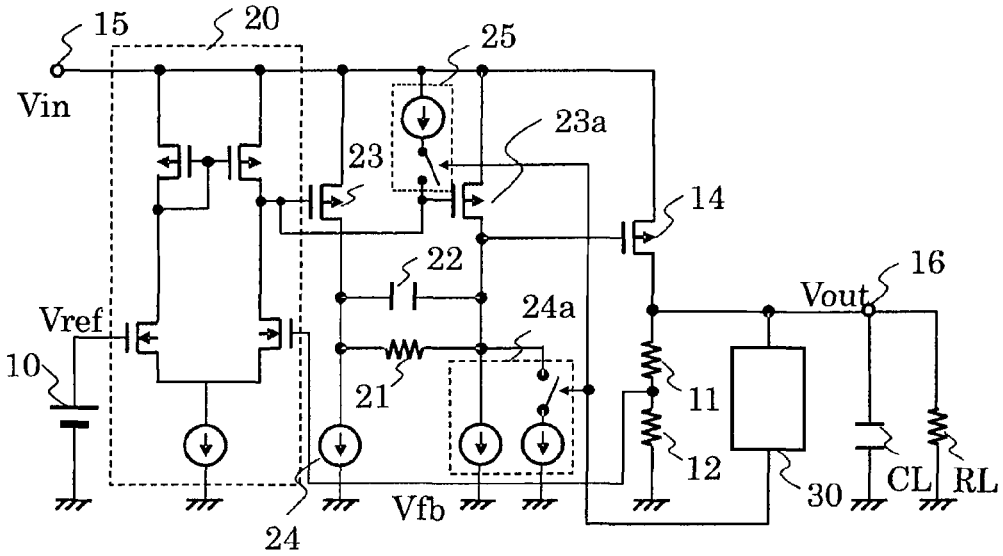
FIG. 6 is a circuit diagram of a voltage regulator according to a fifth embodiment.

FIG. 6 is a circuit diagram of a voltage regulator according to a fifth embodiment.

The voltage regulator further includes a switch circuit sequentially connected to the constant current source 24*a* and a constant current source in addition to the circuit configuration of the fourth embodiment of the present invention.

For example, in the case of an increase in an output load current, the output load current detection circuit 30 supplies electric current from the constant current source 25 to decrease the electric current flowing into the gate terminal of the MOS transistor 14. In addition, the output load current detection circuit 30 is able to set the voltage at the gate terminal of the MOS transistor 14 to a desired voltage quickly by increasing the current value of the constant current source 24*a*, thus improving the transient response characteristics of the voltage regulator.

Although the current value of the constant current source 24*a* is increased in this embodiment, the current value of the constant current source 24 may be increased.

What is claimed is:

1. A voltage regulator comprising:

a differential amplifier circuit which receives an input of a reference voltage output from a reference voltage circuit and an input of a feedback voltage obtained by dividing an output voltage of the voltage regulator and then amplifies and outputs a difference between the reference voltage and the feedback voltage;

a first MOS transistor having a gate terminal connected to an output terminal of the differential amplifier circuit;

a first constant current source which is provided between the first MOS transistor and a ground terminal;

an output MOS transistor having a gate terminal connected to a drain terminal of the first MOS transistor via a phase compensation circuit;

a second MOS transistor having a gate terminal to which an output of the differential amplifier circuit is input and a drain terminal connected to the gate terminal of the output MOS transistor; and a second constant current source provided between the drain terminal of the second MOS transistor and a ground terminal.

2. The voltage regulator according to claim 1, further comprising an output load current detection circuit which detects an increase in load current of an output terminal, wherein a resistor constituting the phase compensation circuit has a resistance value varying according to a detection signal of the output load current detection circuit.

3. The voltage regulator according to claim 1, further comprising an output load current detection circuit which detects an increase in load current of an output terminal, wherein at least one of the first constant current source and the second constant current source increases electric current according to a detection signal of the output load current detection circuit.

4. The voltage regulator according to claim 1, further comprising an output load current detection circuit which detects an increase in load current of an output terminal, wherein the first MOS transistor and the second MOS transistor decrease electric current according to a detection signal of the output load current detection circuit.

5. The voltage regulator according to claim 3, wherein the first MOS transistor and the second MOS transistor decrease electric current according to a detection signal of the output load current detection circuit.

6. The voltage regulator according to claim 1, wherein an aspect ratio of the first MOS transistor and the second MOS transistor is the same as a current value ratio of the first constant current source and the second constant current source.

* * * * *